United States Patent [19]

Kirby

[11] 3,984,877

[45] Oct. 12, 1976

[54] FLUSH TANK WARNING SYSTEM

[76] Inventor: James D. Kirby, 11742 Highwood, Palos Park, Ill. 60464

[22] Filed: Oct. 9, 1975

[21] Appl. No.: 621,118

[52] U.S. Cl. ..... 4/1; 4/67 R
[51] Int. Cl.[2] ..... A47K 17/00
[58] Field of Search ..... 4/1, 67 R, 67 A, 57 P, 4/249, 57 R, 34, 37, 41, 172.17, 172.15

[56] References Cited

UNITED STATES PATENTS

| | | | |
|---|---|---|---|
| 2,004,502 | 6/1935 | Fieberling | 4/1 |
| 2,361,677 | 10/1944 | Bramhall | 4/1 |
| 3,715,549 | 2/1973 | Kraff | 4/1 |
| 3,759,286 | 9/1973 | Page | 4/172.17 |
| 3,848,627 | 11/1974 | Page | 4/172.17 |
| 3,928,874 | 12/1975 | Albertson | 4/67 R X |

*Primary Examiner*—Henry K. Artis
*Attorney, Agent, or Firm*—Merriam, Marshall, Shapiro & Klose

[57] ABSTRACT

A water level monitor and alarm indicates when the drain valve in a toilet flush tank is improperly seated and water is not filling the flush tank as required. The monitor can also be adjusted to indicate when water is overfilling the flush tank. A hollow tube contains a float and fills with water as the tank fills, lifting the float. If water continues filling the tank after a predetermined level is reached, a portion of the float will trip a switch and indicating devices outside the tank will signal the overfill. When the flush tank empties, water is metered from the hollow tube through a variable size opening and gradually lowers the float contained therein, causing the float to descend at a slower rate than the tank water level. If the tank does not begin filling with water at a proper time to intercept the float, the float will continue to descend, and, at a predetermined level, trigger an alarm to signal that the flush tank is not filling.

8 Claims, 6 Drawing Figures

FLUSH TANK WARNING SYSTEM

BACKGROUND OF THE INVENTION

1. Field of the Invention

This invention pertains to a water level monitoring and signaling device for use with a toilet to indicate when the flush tank is not functioning properly.

2. Description of the Prior Art

Conventional toilets used in homes and apartments have a water flush tank and a bowl. Water is admitted through a flow valve to the tank where it is stored for later use. A flush valve at the bottom of the tank provides a rubber ball type member seated atop a pipe that conveys water to the toilet bowl. When the toilet is flushed the ball member is lifted from the pipe and stored water rushes from the tank into the toilet bowl.

Because of most local code requirements, each time a toilet is flushed it is estimated that approximately 5 to 10 gallons of water are expelled from the flush tank to adequately cleanse the bowl. In addition to this required use of water, there is the added concern with the occasional failure of the flush valve to properly seat as required to shut off water flow from the tank and permit the tank to refill. Each time the flush valve functions improperly, not only is the toilet inoperable for a period of time, but there is a waste of water.

Furthermore, failure of the water flow valve, used to shut off the flow of water after the tank is filled, causes the tank to overflow with excess water being drained out via an overflow pipe.

Water has always been a very valued commodity as indicated by the increasing use of water meters and the high rates charged for water. Additionally, from a safety and sanitation standpoint, continuous running of water through a toilet can cause flooding of a septic system with clean toilet water which, while not a health hazard in itself, will soak a septic field and hinder the field's ability to absorb and discharge sewage water as efficiently as if the field were drier.

In large apartment or hotel complexes the concurrent running of a number of toilets can cause an undesirable pressure drop in the water system and adversely affect water distribution.

Prior devices which have attempted to provide a shut-off or monitoring system to detect when a flush tank is not properly filling have included devices such as that disclosed by the Biniores U.S. Pat. No. 3,727,243 (1973). This patent discloses a flush tank valve aimed at shutting off water flow in the event the water closet breaks, causing water within the tank to fall lower than a normal low level point. No provision is made for signaling when the toilet water system is not functioning properly.

The patent to Pariser et al. U.S. Pat. No. 3,138,024 (1964) discloses a liquid level monitoring device whereby a float has a rod connected thereto that moves up and down along a scale to indicate the level of water within the tank. Intermittently, a horizontally arranged probe is actuated to move toward the float supported rod. If the rod has been lowered below the level of the horizontal probe the probe will travel an added distance and contact a switch or other device that actuates a pump to raise the level of water within the tank. Unlike this invention, the Pariser liquid level indicating control requires intermittent operation of a control rod which requires a permanent electrical power supply, or it will result in drainage of batteries if there is a portable power supply being used.

SUMMARY OF THE INVENTION

This invention pertains to a water level monitoring alarm device which may be easily attached to the flush tank of a toilet. When the flush tank is not filling or is overfilling, triggering devices signal such a malfunction.

The monitoring device includes a hollow control tube which can be adjustably positioned in any flush tank. The control tube contains a float or other similar device that is raised and lowered as water fills and drains from the control tube. Proximity switches are electrically connected to alarm signals and are actuated by the float to signal when the flush tank is overflowing or not filling properly.

In operation, when the flush tank is operated and water is rapidly drained from the tank, the water in the control tube is slowly metered out through a control or metering valve at such a rate as to gradually lower the float at a rate slower than the rate the water level in the tank is falling. If the flush valve operates properly after water has flowed from the flush tank, the water level in the filling flush tank will rise fast enough to fill the control tube and intercept the float and prevent it from sinking to the bottom of the hollow tube, at which point an alarm signal would have been generated. Should a malfunction occur and the tank overfills, the float within the control tube is lifted to engage a switch to signal such an overfill condition.

Thus, if the flush tank components are operating properly, the float within the tube is merely raised and lowered a small amount and is not moved to a predetermined point which would energize the flush tank alarm indicating that water was overfilling and not filling the flush tank.

Other features and advantages of the invention will become apparent to those skilled in the art from the following description, attached drawings and appended claims.

DETAILED DESCRIPTION

So far as is practical the same elements or parts which appear in the different views of the drawings will be identified by the same numbers.

Figure 1:
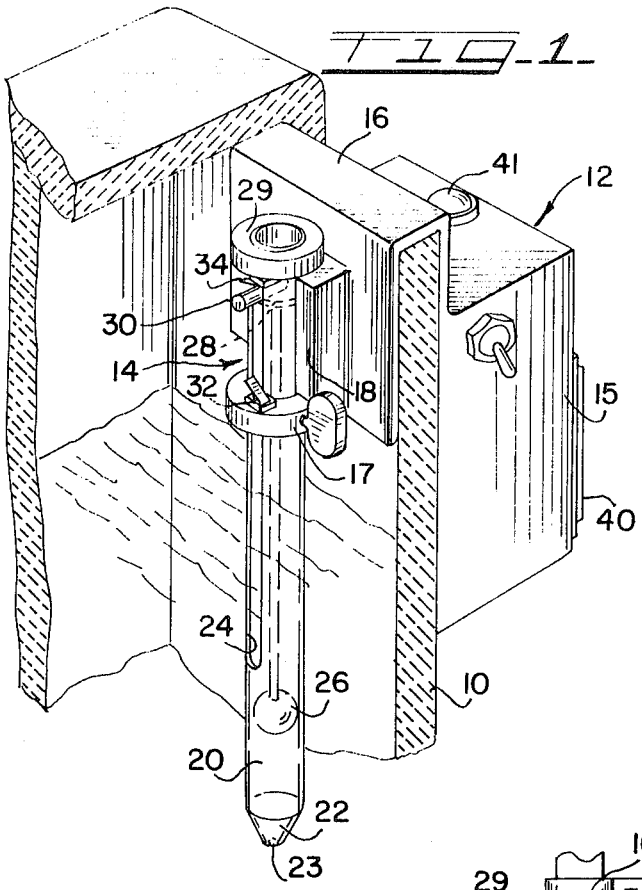
FIG. 1 is a pictorial illustration of the monitoring and alarm device shown mounted on a toilet flush tank with portions of the tank removed for purposes of clarity.

Referring again to the drawings and in particular to FIG. 1, there is shown a portion of the generally constructed flush tank 10 with the flow warning device 12 clipped on one wall thereof. As shown in the drawing, the warning device 12 includes a portion positioned within the interior of the flush tank and designated generally by the numeral 14. A control box 15 is located externally of the flush tank. Mounting bracket 16 provides a U-shaped clip for conveniently and inconspicuously mounting the warning device 12 securely to a wall of the flush tank.

The portion of the mounting bracket 16 that is on the inside of the flush tank 10 provides a locking ring 17 and a pair of vertically extending protrusions 18 (FIG. 1) to receive and guide a control tube 20.

While the illustrated embodiment shows an add-on unit to be attached to an existing flush tank 10, it is contemplated that the means for attaching control tube 20 and/or control box 15 could be a permanent part of the flush tank 10.

Figure 6:
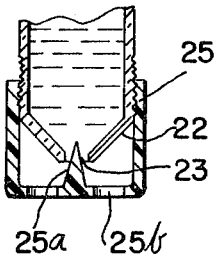
Figure 5:
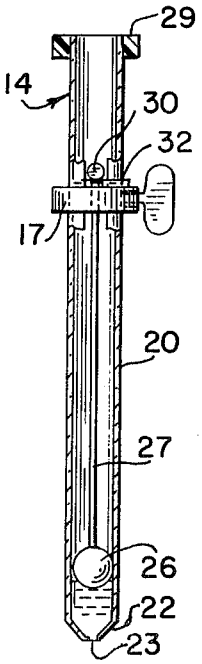
FIG. 5 is a view similar to the illustration of FIG. 4 and shows the float as it would appear when the flush tank is empty and not properly filling; and, FIG. 6 is an enlarged cross-sectional view of a metering valve for adjusting the rate of discharge of water from the water control tube.

The control tube 20 includes an elongated slot 24 and a funnel shaped end 22 containing an opening 23 (FIG. 6). A metering cap 25 (FIG. 6) is adjustably fitted about the end 22 and includes a needle **25*a* for controlling the flow of water through the opening 23. The size of opening 23 is variable to allow for various flow rates of water and reduction in the opening size due to the build-up of mineral deposits or the like. Openings 25*b* in metering cap 25 allow drainage of water from the control tube 20 and also permit a certain amount of filling of the tube as the water level within the tank rises. Elongated slot 24 serves to allow water to rapidly enter the control tube 20 as the water fills the flush tank 10.**

Within the tube 20 is a float 26 and an elongated rod 27. The top portion of the rod 27 has a rod guide 28 in the form of a thin disk attached thereto to maintain the alignment of the rod during vertical movement of the float 26.

Figure 3:
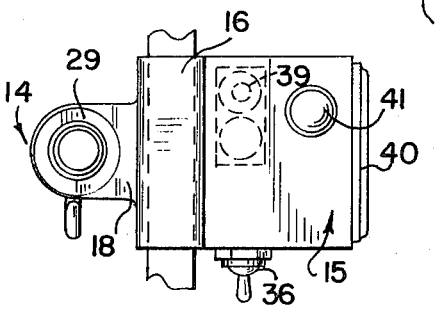
FIG. 3 is a top plan view of the device illustrated in FIG. 1.
Figure 4:
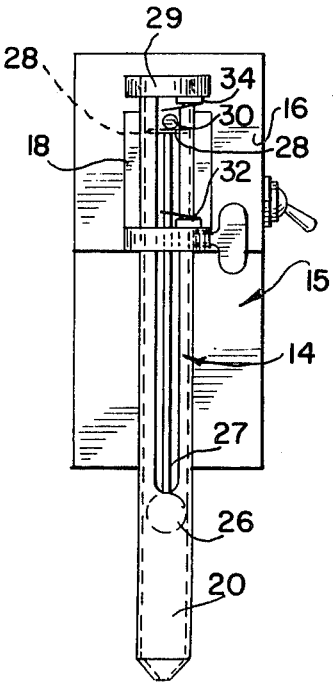
FIG. 4 is an end view of the monitoring device.

At the top of control tube 20 is an annular top flange 29 that may be moved vertically for adjustment purposes to signal when the high water level is exceeded. Laterally extending finger 30 (FIGS. 1, 3) extends from rod 27 and protrudes through the tube slot 24. As the float 26 moves up and down in the tube 20 the finger 30 can move between a lower proximity switch 32 and an upper proximity switch 34. Each contact switch is in the form of a miniaturized unit and is contemplated as being a small switch having waterproof or otherwise shielded contacts to insure long operating life in the humid environment of the flush tank. As shown in FIG. 4, each switch 32, 34 has an actuating arm extending therefrom into the slot area in such a manner as to intersect the finger 30 for operating the respective switches. The switches 32, 34 are coupled with associated electrical equipment within the control box 15.

Control box 15 includes an on/off switch 36 which is used to place the warning device in an operative or inoperative state. Within the control box 15 there may be provided a battery compartment 38 with at least one dry cell battery 39 electrically connected to an audible warning device such as a horn 40 and a visual indicator such as the warning light 41. Electrical connections within the control box 15 may be accomplished by the usual wire, solder and terminal arrangement. Similarly, in other installations, the unit could be wired to the low voltage (i.e., doorbell voltage) electrical system of the house, apartment, hotel or the like. The electrical connection between the control box 15 and the switches 32, 34 may be maintained by electrical conductors sealed within the mounting bracket 16 or another suitable waterproof electrical connection.

In operation, the warning device 12 is initially placed on the side wall of the flush tank and the locking screw of the locking ring 17 is loosened to permit the water column control tube 20 to be adjustably moved vertically until a proper operating position is obtained. The proper operating position depends upon the spacing between the bottom of the metering cap 25 and the bottom of the flush tank. A proper initial adjustment of the tube 20 is obtained by flushing water from the tank and observing the rate of descent of the float 26 as water is metered out of control tube 20. In filling, the flush tank 10 should fill the control tube 20 to a level to intercept the descending float 26 before finger 30 contacts switch 32 to signal the tank is not filling properly. By adjusting the vertical height of the tube 20 and adjusting the metering cap 25, a suitable combination can be obtained whereby the float 26 will not descend to a low point in such a manner as to cause the finger 30 to engage the switch 32 if the flush tank unit is operating and filling properly. In the event the flush tank unit is not operating properly, as would occur if the drain valve has not closed, water would be metered out of the control tube 20 through the metering cap 25 at a slow rate, yet permit the float 26 to descend after a predetermined period of time, for example, thirty seconds, whereby the finger 30 would engage the switch 32 and energize the warning light 41 as well as send out an audible and/or visible warning signal through the warning horn 40 and/or light 41.

After the malfunction is corrected and the tank begins to fill, water initially enters the control tube 20 through the opening **25*b* and the metering cap 25 and passes through the opening 23 in the bottom of the tube 20. While water entering in this manner is rather slow and will not maintain the level of the water in the tube with the level of the water in the tank, once the level of water in the tank reaches the slot 24 in the tube 20 the water will rush into tube 20 and lift float 26, rod 27 and attached finger 30** at the same rate as the rising water within the flush tank.

Figure 2:
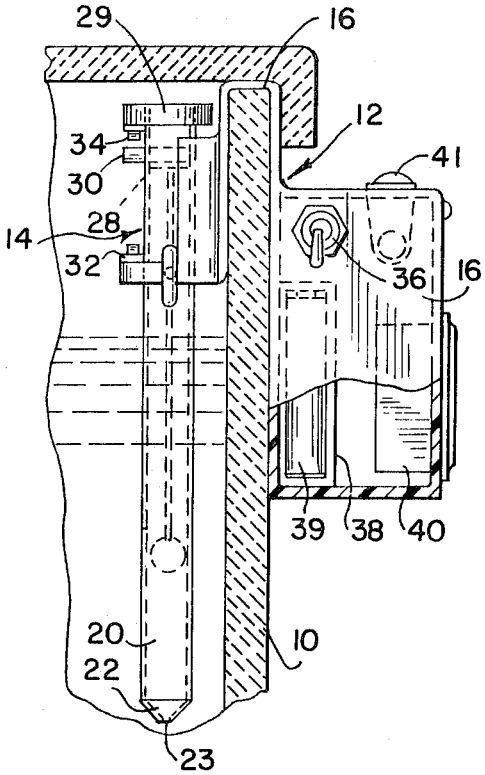
FIG. 2 is a side elevational view of the flush tank and attached monitoring device illustrated in FIG. 1.

As can occur with flush tank units, the inlet water valve may not shut off once the tank has been filled to a suitable degree causing water to overflow through a high level drain pipe. The present invention provides the adjustable top flange 29 with switch 34 mounted thereon for monitoring when a high level has been exceeded and thus will sound an alarm or provide another indication that water is overflowing from the tank 10. As shown in FIG. 1, the annular top flange 29 is fitted about the top portion of the tube 20 in such a manner that the vertical position of flange 29 can be easily adjusted. When the tank 10 has filled to a desirable level the flange 29 is to be moved to a position locating the switch 34 a short distance from the finger 30 as shown in FIGS. 2 and 4. Hence, should the water level continue to rise to an overflow level, finger 30 would engage switch 34 and actuate an alarm signal.

The foregoing description and drawings merely explain and illustrate the invention, and the invention is not limited thereto, as those skilled in the art who have the disclosure before them will be able to make modifications and variations therein without departing from the scope of the invention.

What is claimed is:

1. In a receptacle for storing fluid wherein fluid may be emptied and filled to alternately lower and raise the fluid level in the receptacle, a fluid level monitor comprising:

a control tube;

said control tube having inlet means to admit fluid to the tube as fluid level in the receptacle rises and having outlet means to drain fluid from the control tube;

said outlet means including fluid metering means for lowering a level of fluid within the control tube at a rate slower than the rate of fluid emptying from the receptacle;

means for sensing a lowered fluid level in the control tube and including means fixedly mounted with respect to the control tube with means responsive to a lowered fluid level inside the control tube; and, signal means actuated by the means for sensing a lowered fluid level in the control tube to indicate when fluid has metered from the control tube before the control tube is filled with water as the receptacle is filled.

2. The fluid level monitor of claim 1, wherein said fluid metering means includes:

an outlet opening in said control tube; and, flow regulating means, including adjusting means, movable to vary the size of said outlet opening.

3. The fluid level monitor of claim 1, wherein said means for sensing a lowered fluid level within the control tube includes:

a float;

indicator means movable with said float and having actuating means; and, switch means in alignment with the actuating means of said float for operating the signal means.

4. The fluid level monitor of claim 1, and:

means for sensing a raised fluid level in the control tube and including switch means fixed with respect to the control tube and having circuit element means operable by the raised level of fluid in the control tube to operate the signal means.

5. The fluid level monitor of claim 4, and:

mounting means for attachment of the switch means and including means for adjustably positioning the switch means relative to the control tube.

6. The fluid level monitor of claim 1, and:

means adjustably mounting said control tube for vertical positioning in the receptacle.

7. The fluid level monitor of claim 1, and:

a mounting bracket having means for removably attaching said monitor to the fluid receptacle; and, positioning means on said mounting bracket and having guide surfaces cooperative with the control tube during vertical movement of same.

8. The fluid monitor of claim 7, wherein the mounting bracket includes:

first and second spaced and generally parallel walls depending from a common part, said first wall being associated with the control tube and said second wall being associated with said signal means; and, said positioning means including a pair of spaced, elongated guide protrusions adjacent said control tube.

* * * * *